US007070038B2

(12) United States Patent
Haycock

(10) Patent No.: US 7,070,038 B2
(45) Date of Patent: Jul. 4, 2006

(54) ESCALATOR CHAIN DRIVE MECHANISM

(75) Inventor: Brian Haycock, Dudley (GB)

(73) Assignee: Precision Chains Limited (GB)

( * ) Notice: Subject to any disclaimer, the term of this patent is extended or adjusted under 35 U.S.C. 154(b) by 58 days.

(21) Appl. No.: 10/515,446

(22) PCT Filed: Mar. 4, 2003

(86) PCT No.: PCT/GB03/00888

§ 371 (c)(1),
(2), (4) Date: Nov. 22, 2004

(87) PCT Pub. No.: WO03/074411

PCT Pub. Date: Sep. 12, 2003

(65) Prior Publication Data

US 2006/0021849 A1 Feb. 2, 2006

(30) Foreign Application Priority Data

Mar. 4, 2002 (GB) ..... 0204991.4

(51) Int. Cl.
*B66B 23/14* (2006.01)

(52) U.S. Cl. ..... 198/330; 198/321

(58) Field of Classification Search ..... 198/330, 198/326, 321

See application file for complete search history.

(56) References Cited

U.S. PATENT DOCUMENTS 5,295,568 A * 3/1994 Saito et al. ..... 198/330
5,415,265 A * 5/1995 Kubota ..... 198/328

FOREIGN PATENT DOCUMENTS

GB 2 310 185 8/1997

* cited by examiner

*Primary Examiner*—Gene O. Crawford
*Assistant Examiner*—Mark A. Deuble
(74) *Attorney, Agent, or Firm*—Caesar, Rivise, Bernstein, Cohen & Pokotilow, Ltd.

(57) ABSTRACT

An escalator having a twin chain drive. Each chain 10, 11 comprises links 13 consisting of two side plates 14 interconnected by hollow sleeves 15, 23. The links are pivotally connected together to form a chain by linking plates 18 and pins 19 that are inserted through holes in the linking plates 18 and the bores of first hollow sleeves 15. A rotatably mounted load bearing roller 21, 29 is mounted on each sleeve 15, 23. Second hollow sleeves 23 are provided at spaced intervals along the length of the chains and have a bore that is provided with a double tapered surface 24, 25 that converges at a radial plane 26 midway between the side plates 14 of the respective link 13. An axle 20 is provided at spaced intervals along the chains and comprises a spindle 37 located in the tapered bores of the second hollow sleeve 23 of each chain and a spacer assembly 39, 39*a*, 39*b*, 39*c* located between the pairs of second sleeves 23. Means 38 are provided for clamping the chains 11, 12 and said spacer assemblies 39, 39*a*, 39*b*, 39*c* together axially thereby to hold the chains 11, 12 a predetermined distance apart. Abutting surfaces 40, 41 respectively of the second sleeves 23 and the spacer assemblies 29 are of complementary curved shapes that permit relative movement between the spacer assembly 29 and the second sleeves 23 whilst maintaining the alignment of the axis of each second sleeve 23 orthogonal to the sides of the links 14. The second sleeves 23 having a rotatable guide wheel 33 on at least one end of the axle 20. In use there is a guide rail 36 provided adjacent only one side of one of the chains wherein only one guide wheel 33 on each axle 20 locates on a said rail 36 to provide lateral restraint to the chains 11, 12.

12 Claims, 3 Drawing Sheets

ESCALATOR CHAIN DRIVE MECHANISM

This invention relates to escalators and other conveyors and in particular to twin chain drive mechanisms for such escalators.

BACKGROUND OF THE INVENTION

The twin chain drive comprises two parallel chain loops of the same length arranged to run in synchronism over synchronised sprockets. Steps or pallets are fixed between the two chain loops to corresponding points on each loop. The loops pass around, and are driven in synchronism by driving the sprockets. The chain loops carry the load of the escalator and are usually supported in space by wheels, located on each side of the steps, which run on side-tracks to reduce frictional losses. These wheels are usually mounted at each end of an axle that is fixed either to, or through, corresponding points on each of the two chains. The through-axle is present to resist large cyclic bending forces imposed on the axle by couples determined by the distance between chain centre and its corresponding wheel centre, without subjecting the steps or pallets to fatigue-inducing loading. These couples occur when a particular section of chains, axles and wheels run over any area of the machine that causes the chains to be pulled either away from or toward the wheel running tracks. In this design, the wheels take the entire load carried by the escalator and transverse loads are transferred directly to the chains.

In an alternative design, the wheels are replaced by rollers that are rotatably mounted on the pins of each link of the chains, and the rollers run on tracks or flat surfaces. In this design, the entire load carried by the escalator is taken by the rollers and hence by the chain links. Escalators having twin chain drives suffer from a phenomenon known as "lateral float" by which the steps exhibit a strong tendency to drive themselves into the side panels of the escalator adjacent to the steps, known as skirt panels. This damages the skirt panels, the edges of steps, and often the wheels associated with steps, or the rollers.

It is extremely important to ensure that the steps always remain in perfect alignment and that the steps do not creep sideways and contact the side structure of the escalator. In addition, usually at the top and bottom of an escalator, where the steps meet a horizontal floor surface, there is provided a comb that comprises fingers that match corresponding grooves in each step. Therefore, the steps have to be in perfect alignment with the combs at all times, otherwise the escalator will jam.

One cause of lateral float is a result of one chain stretching slightly more than the other chain. This can happen, for example, in those applications, such as on an underground transportation system, where persons using the escalator stand on one side of each step of the escalator to allow persons to pass by walking up or down the moving escalator on the other side of the steps. The chain on the side where people stand carries a much higher load than the other chain, and over time the more heavily loaded chain can become stretched more than the other chain.

In these circumstances, the alignment of the steps can become distorted causing one edge of the steps to advance ahead of the other edge of the step. This imposes a lateral force on the steps causing them to collide with the fixed side skirt panels. This not only causes damage to the steps, skirt panels and the chains but it also throws the whole run of the escalator out so that the steps jam in the combs at the top and bottom.

Attempts have been made to provide lateral constraint of the steps. In one design, the wheels at each side of the steps are arranged to run in guides at each side of the steps. In an alternative arrangement, the wheels are dispensed with, and the rotatable rollers that are mounted on the pins of each link of the chains have a "V" shaped or channelled profile. The rollers are arranged to run with the channelled profile running on guide tracks so that each chain is constrained laterally. These solutions are not very practical because of the very high loads that the wheels or rollers carry and the high side loads imposed on the chains, and have been found to accelerate wear of the chains. Furthermore, such solutions do not allow one chain to stretch slightly more than the other does without causing the wheels or rollers to try to steer away from a straight-line direction. This increases the lateral forces.

An object of the present invention is to provide an escalator of a twin chain drive type with means for providing lateral constraint of the steps that will tolerate slight misalignment of the chains without causing unacceptable misalignment of the steps.

SUMMARY OF THE INVENTION

According to the present invention there is provided an escalator having a twin chain drive system, each chain comprising links consisting of two side plates interconnected by hollow sleeves on which are mounted load bearing rollers, said links being pivotally connected together to form a chain by linking plates and pins that are inserted through holes in the linking plates and the bores of the sleeves, there being provided on each hollow sleeve, characterised in that the hollow sleeves of selected pairs of sleeves at spaced intervals along the length of the chains each have a bore that is provided with a double tapered surface that converges at a radial plane midway between the side plates of the respective link, and have means for carrying a lateral constraint wheel, there being provided an axle comprising a spindle located in the tapered bores of a the sleeves of each pair of sleeves of each chain, a spacer assembly located between the sleeves of each pair of sleeves, and means for clamping the chains and said spacer assembly together axially thereby to hold the chains a predetermined distance apart, abutting surfaces of each sleeve of each pair of sleeves and the respective spacer assembly being of complementary curved shapes that permit relative movement between the spacer and each sleeve of each pair of sleeves whilst maintaining the alignment of the axis of each sleeve of each pair of sleeves orthogonal to the sides of the links of the chain, there being further provided a rotatable guide wheel on one end of the axle that in use engages a guide rail adjacent only one side of one of the chains.

Preferably a step or pallet of the escalator is attached to each of the axles.

Preferably the guide has a circumferential slot with opposing axially facing sidewalls that in operation engage the guide rail to provide lateral restraint. Ideally the guide rail has a cross sectional shape that is of a complementary shape to that of the slot.

Preferably the spacer assembly comprises a central tubular sleeve that has a fitting at each end that carries an insert and the insert is provided with a curved surface that co-operates with a curved surface on one of the second sleeves of each pair of sleeves.

BRIEF DESCRIPTION OF SEVERAL VIEWS OF THE DRAWINGS

The present invention will now be described, by way of example, with reference to the accompanying drawings, in which.

DETAILED DESCRIPTION OF PREFERRED EMBODIMENTS OF THE INVENTION

Figure 1:
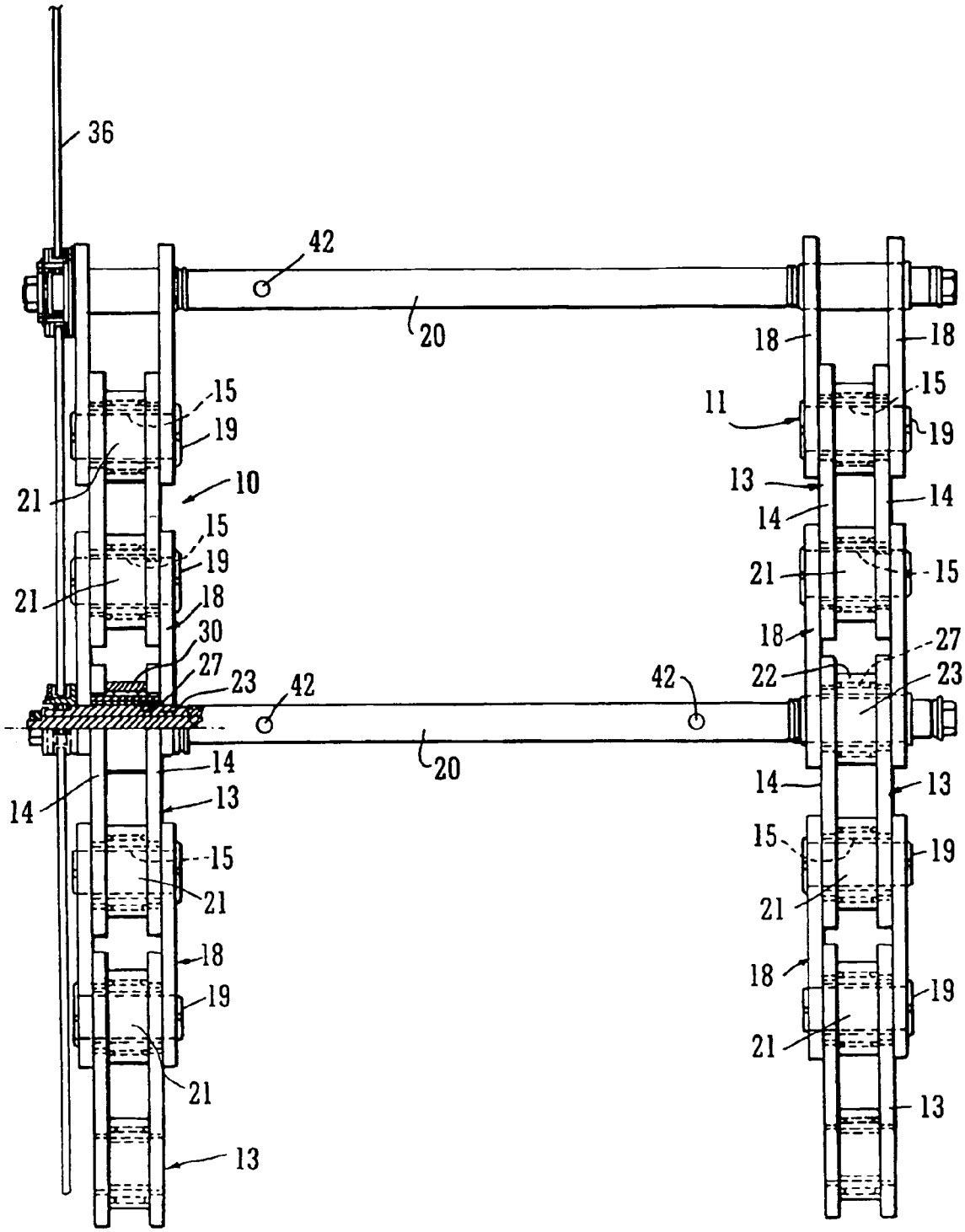
FIG. 1 shows schematically a twin chain drive system for an escalator constructed in accordance with the present invention.

Referring to FIG. 1, there is shown a twin chain drive system for an escalator comprising two spaced chains 11, 12. Each chain 10, 11 passes around driven sprockets (not shown) that are driven in synchronism by an electric motor (not shown) or a hydraulic motor (not shown). The chains 11, 12 are supported and guided to follow a predetermined path around a predetermined loop in a manner well known in the design of escalators.

Figure 2:
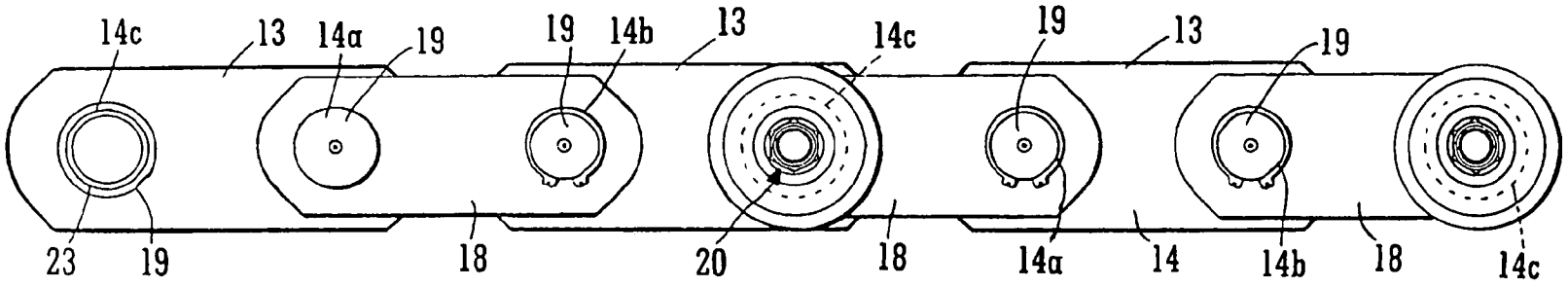
FIG. 2 shows a side view of a part of one of the chains.

Each chain 11, 12 comprises a plurality of first links 13 that consist of two spaced side plates 14 (see FIG. 2) interconnected by interference fit hollow sleeves 15 inserted into the holes 14*a* and 14*b* in the side plates 14 except every third hole 14*c*. The links 13 are connected together to form a chain by two spaced link plates 18 that have two spaced holes that align with the respective holes 14*a*, 14*b*. The links 13 and plates 18 are connected together by pins 19 inserted through all the hollow sleeves 15 in the links 13 and plates 18 except every third hole 14*c*. The pins 19 are held in place by circlips 20 at each end of the pins 19.

The outer diameter of the sleeves 15, in at least the region between the end plates 14, are precision ground, and a load bearing needle roller bearing 21 is mounted on the sleeves 15 between the end plates 14. The outer race 22 of the bearing 21 defines a load-carrying roller 22 that runs on a flat surface of a polymer faced steel rail (not shown) and takes the loads of the respective chains 10, 11.

Figure 4:
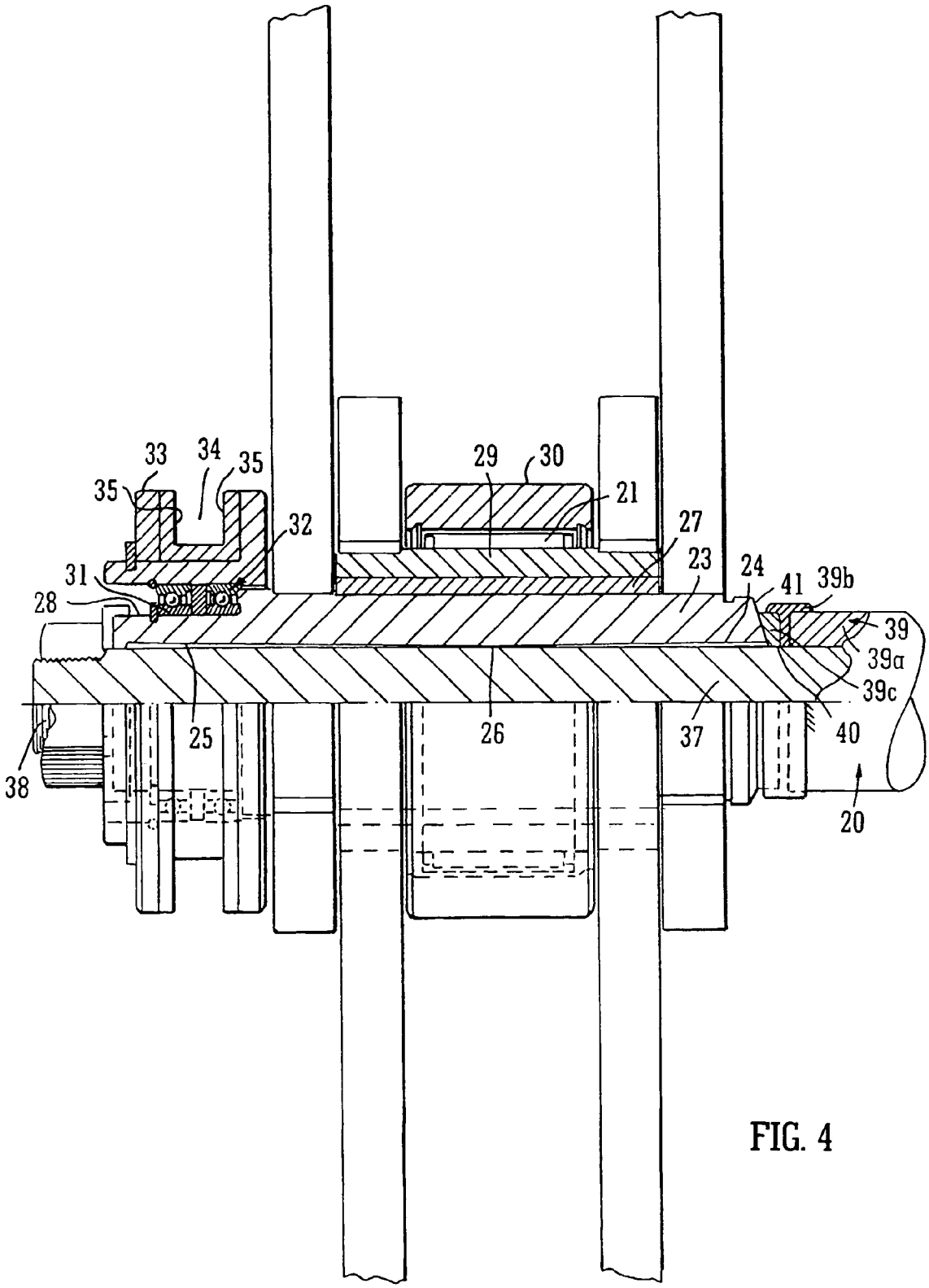
FIG. 4 shows in greater detail one of the rollers of the chain system shown in FIG. 1.

A sleeve 23 is located in every third hole 14*c* around each chain 10, 11 and is of a slightly different design than the sleeves 15 in the other holes 14*a*, 14*b*. The sleeve 23 is shown in FIG. 4. The sleeve 23 is an interference-fit in the holes 14*c* in the end plates 14 of each link 13. Each sleeve 23 has a bore which has two tapers 24, 25 (each of approximately 1° taper) that meet at a cylindrical region 26 that bisects the radial plane of the respective chain midway between the side plates 14, 18 of the links 13.

Figure 3:
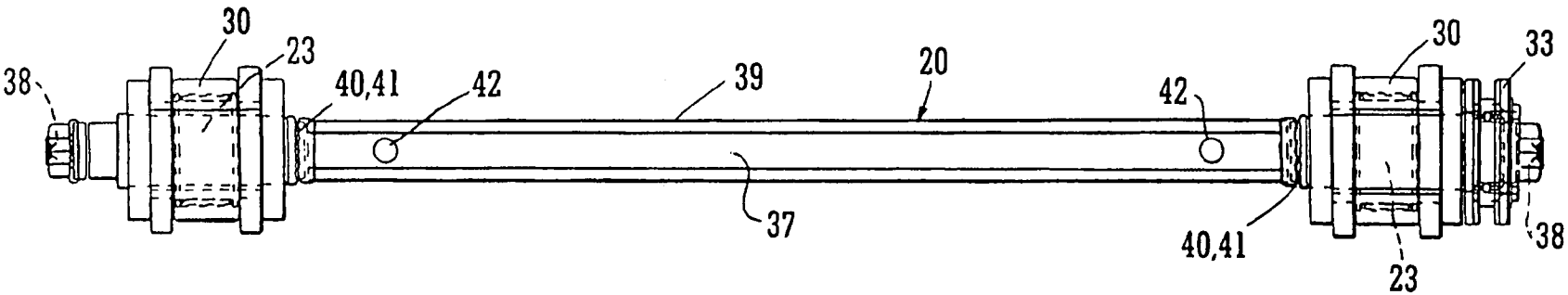
FIG. 3 illustrates schematically a part cross sectional view of one of the axles of the system shown in FIG. 1.

An axle 20 (shown in FIG. 3) that interconnects the two chains 11, 12 is inserted in the bore of each sleeve 23 and replaces the pins 19 that are used in the sleeves 15. The axle 20 will be described in more detail below in relation to FIGS. 3 and 4.

The sleeve 23 has two cylindrical axially spaced outer surfaces 27, 28. A needle roller bearing 29 is mounted on the surface 27 between the end plates 14. The outer circumference of the outer race 30 of the bearing 29 constitutes a load bearing roller 30 that runs on the same flat surface of the polymer faced rail that the rollers 22 run on, and carries the load of the steps of the escalator.

Mounted on the cylindrical surface 28 is the inner race 31 of a double ball thrust bearing 32. A guide wheel 33 is mounted on, or forms the outer race of the bearing 32.

The guide wheel 33 has a polymer insert 34 that has a circumferential slot with radially extending mutually opposing side surfaces 35. A fixed steel guide rail 36 (shown schematically in FIG. 1) is provided at one side only of the pair of chains 11, 12. The guide rail 36 is of rectangular cross section and is designed to take the side forces generated by the escalator in use. The guide wheel 33 is dimensioned and arranged relative to the guide rail 36 so that, in use, the wheel 33 sits over the guide rail with the side-walls 35 just clear of the sides of the guide rail 36. The base of the guide wheel 33 does not contact the rail 36. In this way, all the loads on the escalator are taken by the rollers 22 on sleeves 15 and the rollers 30 on sleeves 23 and not by the wheels 33, and the wheels 33 take all of the side loads and react them against the rail 36.

The guide rail 36 extends around the whole loop followed by the chains 11, 12 alongside one of the chains. At the region where the chains 11, 12 change direction (at the top and bottom of the ascending and descending runs where they change to horizontal runs, and around sprockets or other turns) the guide rail 36 is aligned with a stationary or rotating disc (not shown) that fits into the slot 35 in the wheels 33.

Each axle 20 comprises a central spindle 37 that has a screw thread 38 at each end. The spindle 37 has a precision ground outer diameter and is inserted into the bore of two sleeves 23 (one in each chain) and has a central spacer assembly 39 that keeps the chains 11, 12 a predetermined distance apart. The spacer assembly 39 comprises a central tubular sleeve 39*a* that has a fitting 39*b* at each end and an insert 39*c*. The two chains, 11, 12 are aligned with each other and rigidly held a fixed distance apart by tightening nuts 34 on the screw threads on each end of the spindle 37. Initially, the two chains 11, 12 are accurately positioned so that they are exactly aligned in synchronism and the cylindrical portion 26 of the bore of the sleeve 23 sit on the spindle 37.

The tapers 24, 25 in the bores of the sleeves 23 allow one chain to stretch relative to the other by a small amount. This stretching is accommodated by allowing the central spacer assembly 39 to move out of alignment with the sleeves 23 by a small angle (up to 0.15°) whilst allowing the sleeves 23 to remain orthogonal to the length of the chains 11. 12. This is achieved by providing complementary concave and convex surfaces 40, 41 respectively on the abutting surfaces of the inserts 39*c* of the spacer assembly 39 and the sleeves 23. This allows sliding movement between the concave and convex surfaces 40, 41 whilst still keeping the axes of the sleeves 23 orthogonal to each respective chain 11, 12. In other words the axes of the two sleeves 23 on each axle 20 and the spacer 39 form a lazy "Z" shaped line.

The spacer 39 and spindle 21 has a hole 42 at each end to receive a screw 43 that secures a step 44 of the escalator in position on each axle 20. Each step 44 is constrained laterally solely by the wheels 33 running on the guide rail 36 and not by the chains 11, 12. Stretching of one chain more than the other does not cause the rollers 21, 30 to steer away from a straight line because they remain orthogonal to the length of the respective chain. Since the guide wheel 33 is provided at only one end of the axle 20, advancement of one chain relative to the other causes the spacer assembly 39 to assume a position in contact with one of the tapers 24, 25 in the bores of each respective sleeve 23 and this allows the spacer assembly 39 to compensate for displacement of the sleeves 23 relative to each other in directions radial to the centreline of the inner shaft 37.

To extend the working life of the chains 11, 12 when stretching of one chain 11, 12 exceeds a predetermined value, it is usual to swap the chains 11, 12 over. To accommodate such swapping, a redundant guide wheel 33 may be provided at the other end of the axle 20 to that where the wheel 33 that co-operates with the guide rail 36 is located. In this case the redundant wheel 33 does not run on a guide rail 36 and performs no function until the chains 11, 12 are swapped over.

What is claimed is:

1. An escalator having a twin chain drive system, each chain comprising links consisting of two side plates interconnected by hollow sleeves on which are mounted load bearing rollers, said links being pivotally connected together to form a chain by linking plates and pins that are inserted through holes in the linking plates, and through the bores of the sleeves, characterised in that the hollow sleeves of pairs of selected sleeves spaced at intervals along the length of the chains, each have a bore that is provided with a double tapered surface that converges at a radial plane midway between the side plates of the respective link, and means for carrying a lateral constraint wheel, there being provided an axle comprising a spindle located in the tapered bores of the sleeves of each pair of sleeves of each chain, a spacer assembly located between the sleeves of each pair of sleeves, and means for clamping the chains and said spacer together axially thereby to hold the chains a predetermined distance apart, abutting surfaces of each sleeve of each pair of sleeves and the spacer assembly being of complementary curved shapes that permit relative movement between the spacer assembly and each sleeve of each pair of sleeves whilst maintaining the alignment of the axis of each sleeve of each pair of sleeves orthogonal to the sides of the links of the chain, there being further provided on one end of each axle a rotatable guide wheel that in use engages a guide rail adjacent only one side of one of the chains.

2. An escalator as claimed in claim 1, wherein a step or pallet of the escalator is attached to each axle.

3. An escalator as claimed in claim 1, wherein the guide wheel has a circumferential slot with opposing axially facing side walls that in operation engage the guide rail to provide lateral restraint.

4. An escalator as claimed in claim 3, wherein the guide rail has a cross sectional shape that is of a complementary shape to that of the slot.

5. An escalator as claimed in claim 3, wherein the spacer assembly comprises a central tubular sleeve that has a fitting at each end that carries an insert and the insert is provided with a curved surface that co-operates with a curved surface on each sleeve of the pair of sleeves.

6. An escalator as claimed in claim 4, wherein the spacer assembly comprises a central tubular sleeve that has a fitting at each end that carries an insert and the insert is provided with a curved surface that co-operates with a curved surface on each sleeve of the pair of sleeves.

7. An escalator as claimed in claim 2, wherein the guide wheel has a circumferential slot with opposing axially facing side walls that in operation engage the guide rail to provide lateral restraint.

8. An escalator as claimed in claim 7, wherein the guide rail has a cross sectional shape that is of a complementary shape to that of the slot.

9. An escalator as claimed in claim 8, wherein the spacer assembly comprises a central tubular sleeve that has a fitting at each end that carries an insert and the insert is provided with a curved surface that co-operates with a curved surface on each sleeve of the pair of sleeves.

10. An escalator as claimed in claim 7, wherein the spacer assembly comprises a central tubular sleeve that has a fitting at each end that carries an insert and the insert is provided with a curved surface that co-operates with a curved surface on each sleeve of the pair of sleeves.

11. An escalator as claimed in claim 2, wherein the spacer assembly comprises a central tubular sleeve that has a fitting at each end that carries an insert and the insert is provided with a curved surface that co-operates with a curved surface on each sleeve of the pair of sleeves.

12. An escalator as claimed in claim 1, wherein the spacer assembly comprises a central tubular sleeve that has a fitting at each end that carries an insert and the insert is provided with a curved surface that co-operates with a curved surface on each sleeve of the pair of sleeves.

* * * * *